US011381037B2

(12) United States Patent
Krueger

(10) Patent No.: US 11,381,037 B2
(45) Date of Patent: Jul. 5, 2022

(54) ELECTRICAL PLUG REPAIR DEVICE

(71) Applicant: Christopher K. Krueger, Walnut Creek, CA (US)

(72) Inventor: Christopher K. Krueger, Walnut Creek, CA (US)

( * ) Notice: Subject to any disclaimer, the term of this patent is extended or adjusted under 35 U.S.C. 154(b) by 0 days.

(21) Appl. No.: 17/163,682

(22) Filed: Feb. 1, 2021

(65) Prior Publication Data

US 2021/0296825 A1 Sep. 23, 2021

Related U.S. Application Data

(60) Provisional application No. 62/991,544, filed on Mar. 18, 2020.

(51) Int. Cl.

| | |
|---|---|
| ***H01R 13/639*** | (2006.01) |
| ***H01R 13/66*** | (2006.01) |
| ***H01R 13/05*** | (2006.01) |
| ***H01R 13/42*** | (2006.01) |
| ***H01R 24/28*** | (2011.01) |
| ***H01R 103/00*** | (2006.01) |

(52) U.S. Cl.

CPC ..... *H01R 13/6392* (2013.01); *H01R 13/05* (2013.01); *H01R 13/42* (2013.01); *H01R 13/665* (2013.01); *H01R 24/28* (2013.01); *H01R 2103/00* (2013.01)

(58) Field of Classification Search

CPC .. H01R 4/2433; H01R 4/2412; H01R 4/2404; H01R 4/2408; H01R 13/562; H01R 24/20; H01R 24/28; H01R 2103/00; H01R 13/6392; H01R 13/665; H01R 13/05; H01R 13/42

USPC ..... 439/409, 410, 447, 411–413, 445, 417, 439/687, 696

See application file for complete search history.

(56) References Cited

U.S. PATENT DOCUMENTS

| | | | | |
|---|---|---|---|---|
| 2,756,402 A * | 7/1956 | Haworth | H01R 24/20 | 439/447 |
| 3,792,415 A * | 2/1974 | Fuller | H01R 13/5213 | 439/588 |
| 4,413,872 A * | 11/1983 | Rudy, Jr. | H01R 4/2462 | 439/387 |
| 4,842,546 A * | 6/1989 | Song | H01R 4/2404 | 439/409 |
| 4,995,830 A * | 2/1991 | Eckhaus | H01R 4/2491 | 439/409 |
| 5,004,432 A * | 4/1991 | Tucker | H01R 4/2433 | 439/417 |

(Continued)

*Primary Examiner* — Gary F Paumen

(74) *Attorney, Agent, or Firm* — Law Office of Dorian Cartwright; Dorian Cartwright

(57) ABSTRACT

An electrical repair plug device replaces an original plug device that has been severed from the electrical cord. A housing comprises a base enclosure and a top enclosure that snap together to secure the housing to the electrical power cord. A strainer comprises a strain relief on one end coupled to the electrical power cord and the housing. The strain relief provides support for conduction wires exposed from a skin of the electrical power cord by decoupling external force on the electrical power cord from the conduction wires. The housing includes individual channels for each of the exposed conduction wires, each individual channel insulated from each other and including a plurality of teeth to bite the exposed conduction wires.

20 Claims, 11 Drawing Sheets

(56) References Cited

U.S. PATENT DOCUMENTS

| | | | | | |
|---|---|---|---|---|---|
| 5,252,081 | A * | 10/1993 | Hart | H01R 13/652 | 439/98 |
| 5,295,859 | A * | 3/1994 | Kawai | H01R 13/506 | 439/447 |
| 5,340,330 | A * | 8/1994 | Dolson | H01R 13/562 | 439/445 |
| 7,275,952 | B1 * | 10/2007 | Fabian | H01R 4/2433 | 439/409 |
| 7,789,695 | B2 * | 9/2010 | Radle | H01R 31/085 | 439/402 |
| 8,512,066 | B2 * | 8/2013 | Lee | H01R 4/2433 | 439/395 |
| 2004/0110426 | A1 * | 6/2004 | Castaldo | H01R 24/28 | 439/696 |
| 2004/0219821 | A1 * | 11/2004 | Makita | H01R 13/5205 | 439/445 |
| 2005/0287862 | A1 * | 12/2005 | Castaldo | H01R 13/5833 | 439/409 |

* cited by examiner

ELECTRICAL PLUG REPAIR DEVICE

CROSS-REFERENCE TO RELATED APPLICATIONS

This application claims the benefit of priority under 35 U.S.C. 119(e) to US Application No. 62/991,544, filed Mar. 18, 2020, entitled ELECTRICAL REPAIR DEVICE, by Christopher Krueger, the contents of which being hereby incorporated by reference in its entirety.

FIELD OF THE INVENTION

The invention relates generally to electrical devices and more specifically, to an improved electrical plug repair device.

BACKGROUND

Generally, the first part of an electrical tool or cord to wear out or become damaged is the cord end. Contacts get bent, break off, fray, and generally fail early in relation to the rest of the cord and/or the tool connected to it.

Currently cord end replacement involves multiple-step assembly, requiring both time and skills. Even still, these cord replacement products do not result in an end product that resembles a factory molded connection. Instead, they are bulky and are visibly obvious after-market fixes, many of which would not be allowed on construction sites. There is a general resistance to using the available repair methods because of the effort required for a sub-optimal repair solution. Non-working power supply lines and tools cost significant lost time, including labor and equipment. The cost of replacement tools and cords and delays associated with their procurement are not insignificant.

What is needed is a robust electrical repair device to replace an original electrical device to make cord repair fast, safe and easy for untrained users to complete.

SUMMARY

The shortcomings of the prior art are addressed by an electrical plug repair device to replace an original plug device and methods thereof.

In one embodiment a housing comprises a base enclosure and a top enclosure that snap together to secure the housing to the electrical power cord. A strainer comprises a strain relief on one end coupled to the electrical power cord and the housing. The strain relief provides support for conduction wires exposed from a skin of the electrical power cord by decoupling external force on the electrical power cord from the conduction wires.

In another embodiment, the housing includes individual channels for each of the exposed conduction wires, each individual channel insulated from each other and including a plurality of teeth (or tab fingers) to bite the exposed conduction wires. Male electrical prongs can be coupled to the housing configured for insertion to the electrical plug to draw electrical power for the electrical device, in one implementation. Female electrical prong receivers can be coupled to the housing configured for insertion of electrical prongs, in another implementation. Each of the individual channels supports one of the electrical prongs for electrical connection to an exposed wire.

Advantageously, an electrical plug can be repaired easily with a knife or cutter tools. Furthermore, expensive electronic devices have extended life after plug failure.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

Figure 1A:
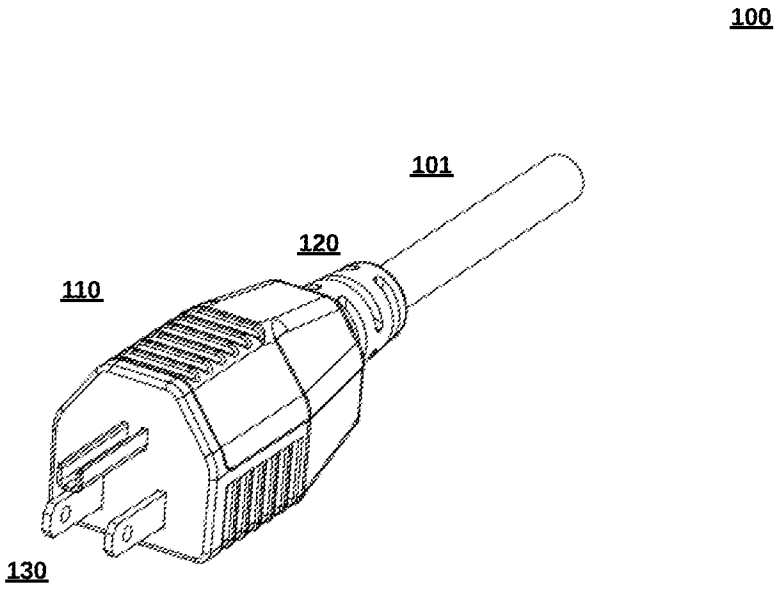
FIG. 1A illustrates a perspective view of a male electrical plug repair device, with a closed housing, according to an embodiment of the present invention.
Figure 1B:
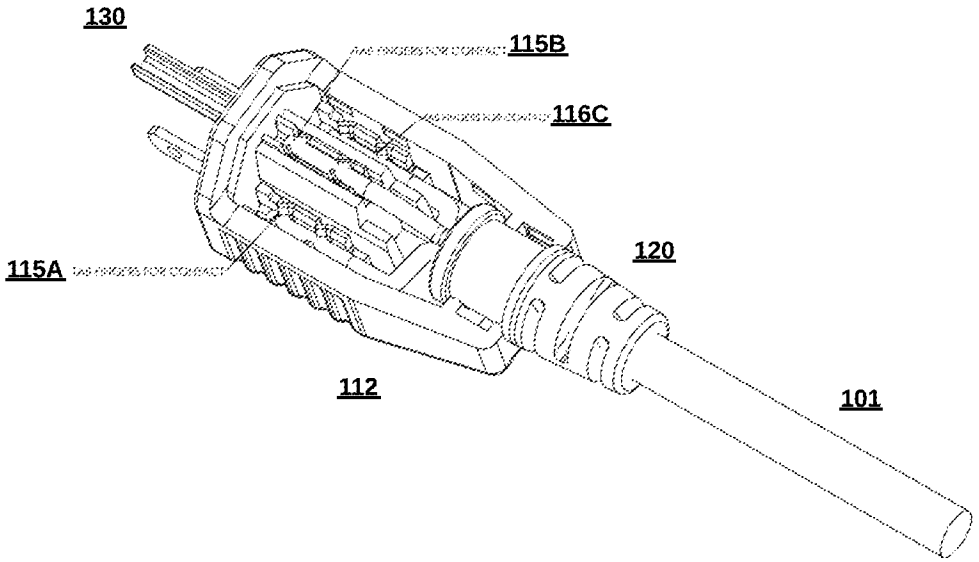
FIG. 1B illustrates a perspective view of a base housing of the male electrical plug repair device, with the top housing removed, according to an embodiment of the present invention.
Figure 1C:
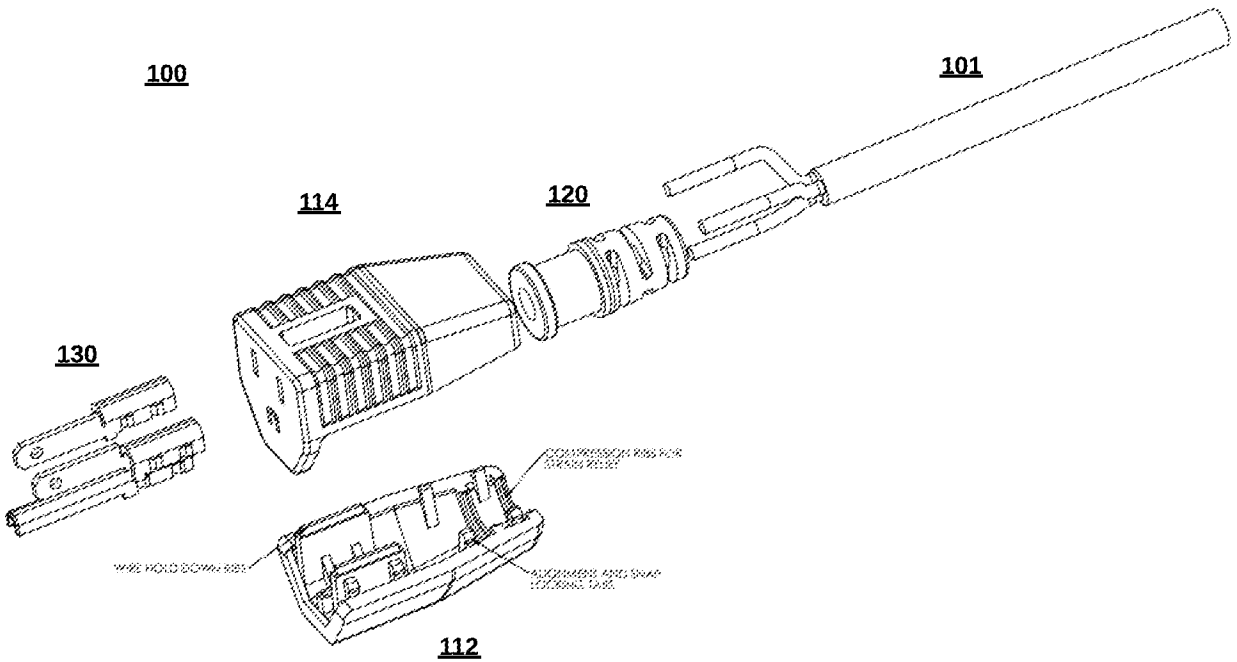
FIG. 1C illustrates a bottom exploded view of the male electrical repair device, according to an embodiment of the present invention.
Figure 1D:
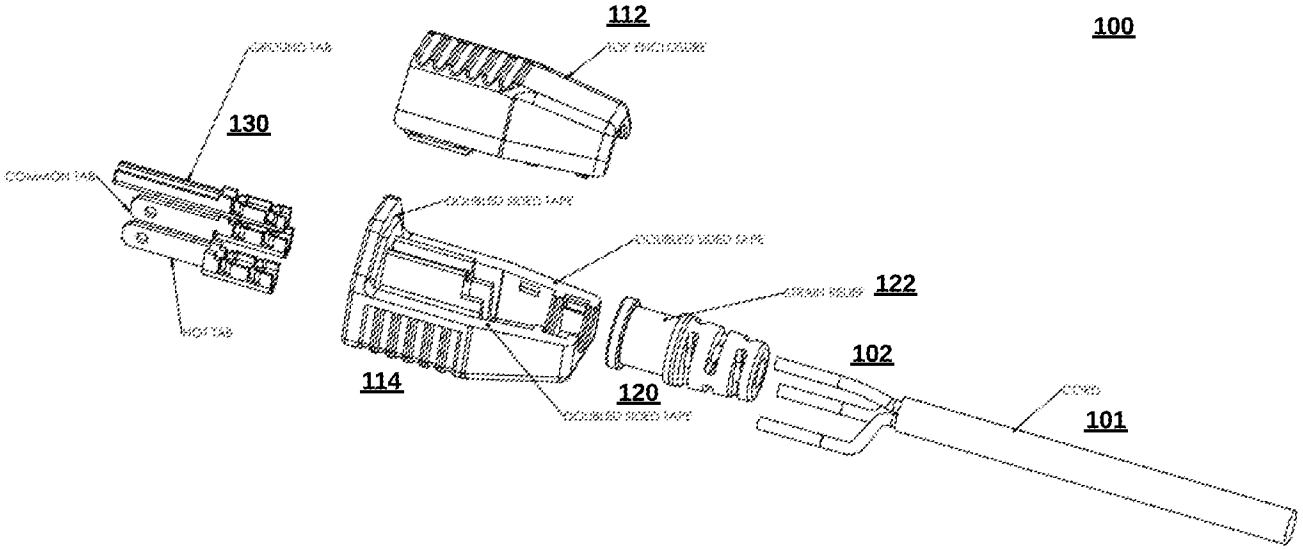
FIG. 1D illustrates a top exploded view of the male electrical repair device, according to an embodiment of the present invention.
Figure 1E:
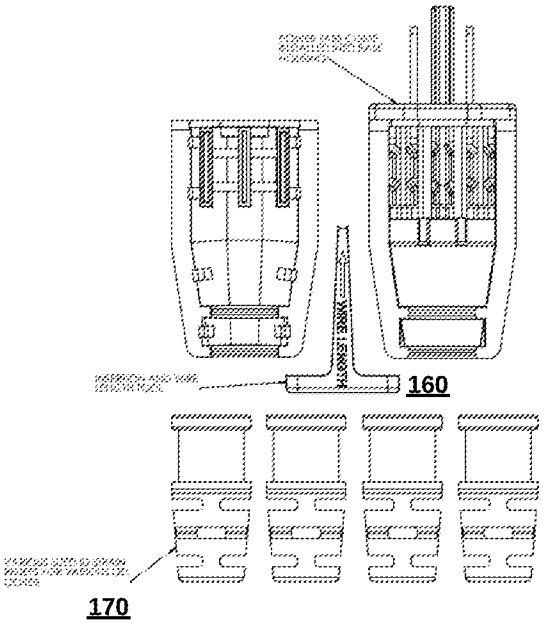
FIG. 1E illustrates various sized strain relief options for connection of various types and sizes of electrical cords for the male electrical repair device, according to embodiments of the present invention.

An electrical plug repair device and methods thereof, are described herein. One of ordinary skill in the art will recognize many additional possible embodiments, based on the following disclosure, that have not been included for the sake of brevity.

I. Electrical Plug Repair Device

FIGS. 1A-1E illustrate various perspective views of a male electrical plug repair device 100, according to an embodiment of the present invention. The device 100 includes a housing 110, a strainer 120 and male prongs 130. Generally, the device 110 can be NEMA (National Electrical Manufacturers Association) 5-15-compliant and have ratings such as 110 V, 125 V, 220 V, 15 Amp, or 1000 Watts for connecting electrical power from an electrical outlet to a corded electronic device, for instance an appliance, computing device, lamp, vacuum, or power tool. Electricity from the electrical outlet travels through the device 100 for power as needed.

Many other variations of the device 100 are possible. For example, the male prongs 130 can alternatively be implemented as female prongs, without any prongs (e.g., magnets), or as gender neutral. In another example, multiple male or female prongs can be provided. In still another embodiment, a USB male, an HDMI male, an Ethernet male, or any other appropriate connector is implemented for different cords or cables. Wires within the cord can be different sizes (e.g., 10, 12, 14, 16 or 18 gauge) and be composed of electrically conducting material such as copper, bronze, silver, or gold. Cords can carry power, electrical data, or power and electrical data. In one case, the cord is an extension cord with two outlets ends (e.g., female and male, male and male, or female and female). The device 100 can also be GFCI (ground-fault circuit interrupters)-compliant or protect from power surges. Components of the device 100 can be built for household or heavy-duty commercial uses. In some embodiments, the device 100 is configured for foreign markets such as Europe, Asia and the Americas.

The housing 110 is made from plastic, rubber, or other insulators. Functionally, the housing 110 is a common chassis coupling to both the strainer 120 and the male prongs 130 couple. In one embodiment, the strainer 120 is on an opposite end of the housing 110 from the male prongs 130. But other embodiments are possible, such as a 90-degree orientation, or an adjustable orientation. The housing 110 encloses the electrical components as protection from exterior elements. At the same time, the housing 110 insulates the electrical components from conducting electricity outside of the cords. In operation, a lower housing 112 clamps into fittings of an upper housing 114. As described in more detail below, the device 100 can be self-terminating during assembly, when the upper housing 112 and lower housing 114 are closed to secure components of the device 100 and determinatively closes the circuit for optimal electrical power (or electrical data) conduction. Teeth within channels bite through a protective coating of the interior wires to create an electrical contact.

The strainer 120 is preferably made of rubber for flexibility, plastic for durability, or other appropriate materials. The strainer 120 decouples exterior forces on the device 100 from electrical wires within the device 100. In one embodiment, electrical wires are fish-eyed through the strainer 120 to capture electrical wiring. Different sized strainers can be provided for different sized cordage or different sized wires. A strain relief 122 on one end of the strainer 120 is enclosed within the housing 110 during assembly. In the illustrated embodiment, lips around the strain relief 122 meet compression ribs in the upper housing 112 and the lower housing 114 to dampen stress caused by plugging, unplugging, tripping over the cord, and gravity, as a few examples of what cause exterior forces. An additional layer of protection is provided by bonding to the cord as a skin to electrical wires rather than bonding to electrical wires. Various sizes of strain reliefs 170 can be provided.

The male prongs 130 include a common tab, a hot tab, and a ground tab (or blades) formed from electrically conducting metal materials to mate three electrical wires. Another embodiment does not include the ground tab. The tabs can be separately attached to the housing 110, or all three tabs can be attached to a common backing that slides into the housing 110. In the illustrated embodiment, the housing 110 includes three channels with tab fingers or teeth for electrical contact. During assembly, the tabs can slide into the channels vertically with perpendicular force, or the tabs can slide into place horizontally through holes with parallel force.

FIGS. 2A-2E illustrate various perspective views of a female electrical plug repair device 200, according to an embodiment of the present invention. The device 200 includes a housing 210, a strainer 220 and female prong receivers 230. Female electrical prong receivers can be coupled to the housing configured for insertion of electrical prongs. Various sizes of strain relieves 270 can be provided for different options.

Figure 2A:
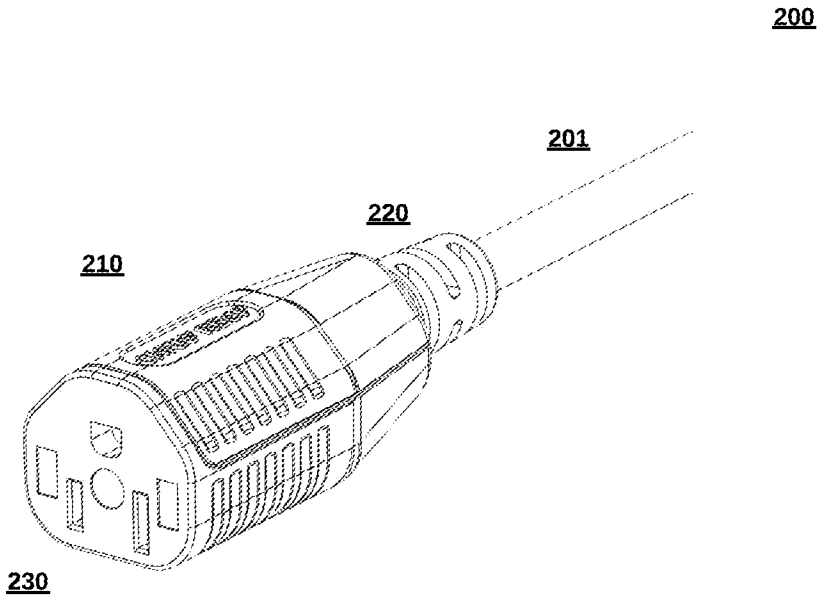
FIGS. 2A-2E are perspective views of a female electrical plug repair device implementation of the male electrical plug repair device of FIGS. 1A-1E.
Figure 2B:
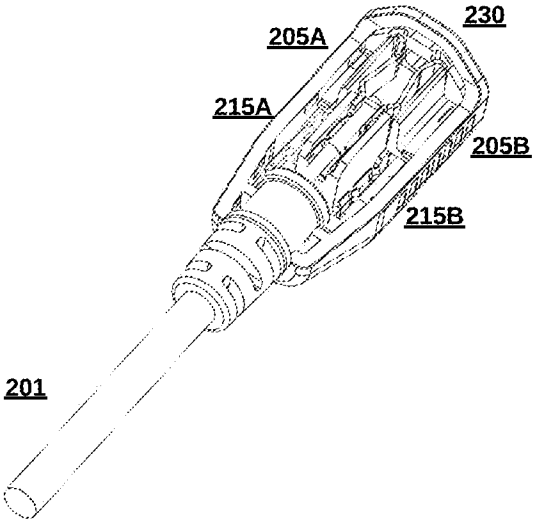
Figure 2C:
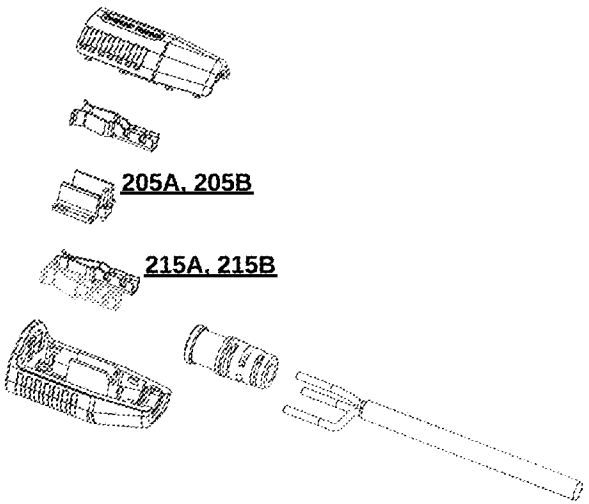
Figure 2D:
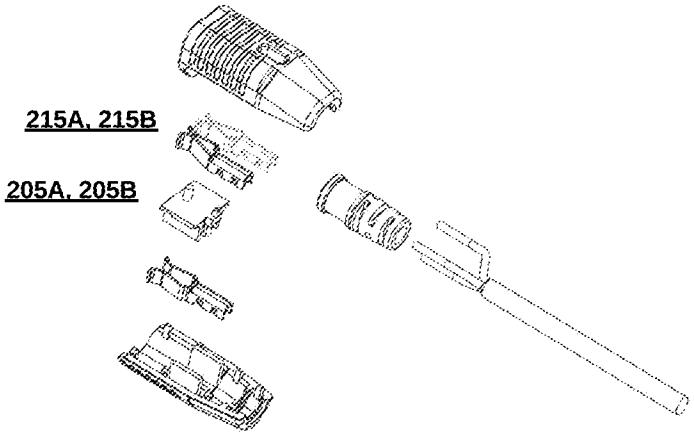
Figure 2E:
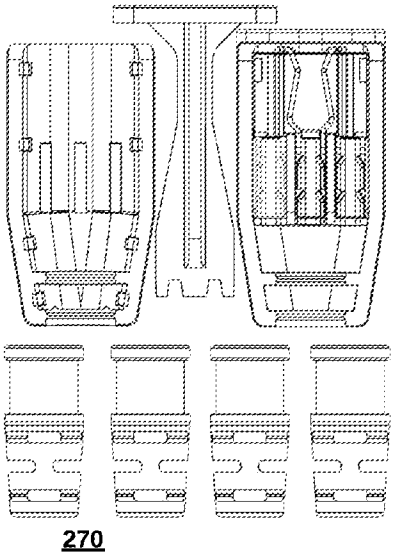

As shown in FIG. 2B, female electrical prong receivers 205A, 205B are connected to electrical conductors 215A, 215B. When male electrical prongs are inserted, the receivers 205A, 205B secure an electrical connection for conduction of electricity.

Figure 3:
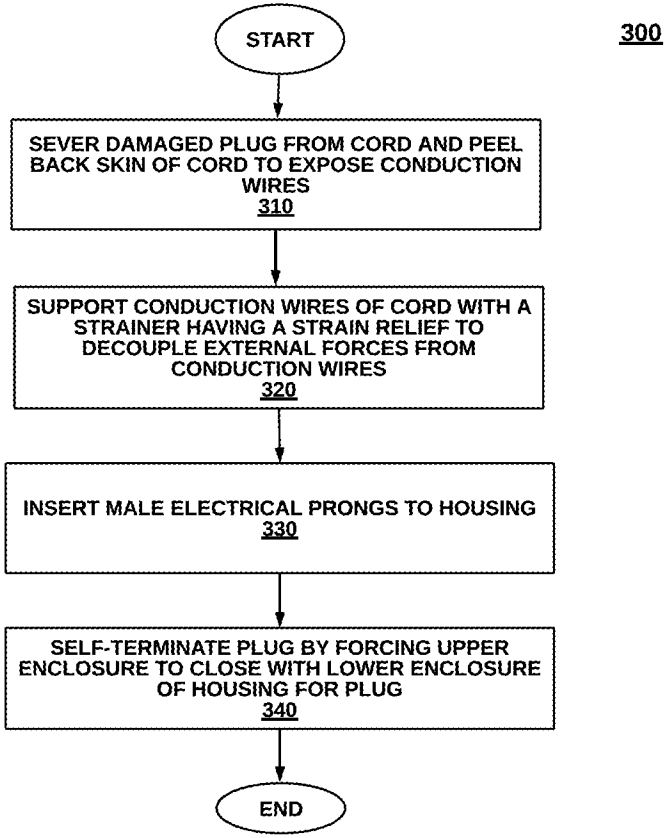
FIG. 3 is a flow chart illustrating a method for repairing an electrical power cord with an electrical plug repair device, according to an embodiment of the present invention.

II. Method for Repairing an Electrical Power Cord with an Electrical Plug Repair Device FIG. 3 is a flow chart illustrating a method 600 for repairing an electrical power cord with an electrical plug repair device, according to an embodiment of the present invention. The method 600 can be implemented in the device 100 or any other appropriate electrical plug replacement. One embodiment requires no screws or tools for installation.

At step 310, an old, damaged electrical plug is removed from an electrical cord by cutting. A skin of the electrical cord is peeled back to a certain length (e.g., 1 or 2 inches) to expose enough of the interior cords for connection.

At step 320, conduction wires are supported with a strainer having a strain felief for coupling to the housing. Removal of the old, defective plug can be done many ways. One example is to cut plug off, and then remove part of the skin to expose a minimum length of the interior conducting wires. The cord can then be fish-eyed through the strainer hole. In another embodiment, the strainer opens along its length and then snaps into place around the cord when closed. Next, the individual conducting wires are each forced into separate channels by tool or by hand.

At step 330, male electrical prongs are inserted to the housing. In one case, male electrical prongs (or female electrical prong receivers) are preassembled to the housing. In another case, a gender is determined and appropriate terminators are inserted for the gender.

At step 340, the electrical power cord is secured to the housing by snapping an upper enclosure to a lower enclosure. In one embodiment, the snapping force self-terminates by actuating bite on the wires to complete a conduction circuit. For instance, teeth within the channels can be actuated to bite an individual conducting wire within its channel.

III. Additional Embodiments

Generally, one of ordinary skill in the art will recognize that the examples set forth herein are non-limiting and only illustrative of widely-applicable principles. Accordingly, this description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

I claim:

1. An electrical plug repair device to repair a connection between an electrical power cord powering an electrical device and an electrical plug, comprising:

a housing, comprising a base enclosure and a top enclosure that snap together to secure the housing to the electrical power cord;

a strainer to encapsulate a first end of the electrical power cord and comprising a strain relief coupled to the housing, wherein the strain relief provides support for conduction wires exposed from a skin of the first end of the electrical power cord by decoupling external force on the electrical power cord from the conduction wires, wherein the housing includes individual channels for each of the exposed conduction wires, each individual channel insulated from each other and including a plurality of teeth to bite the exposed conduction wires; and male electrical prongs or female electrical prong receivers coupled to the housing and configured for insertion to the electrical plug to draw electrical power for the electrical device, wherein each of the individual channels supports one of the electrical prongs for electrical connection to an exposed wire.

2. The electrical plug repair device of claim 1, wherein when the housing is closed with the top enclosure snapped to the base enclosure, the plurality of teeth bite the exposed conduction wires.

3. The electrical plug repair device of claim 1, wherein the housing is configured to have the male electrical prongs removed for replacement with a female plug.

4. The electrical plug repair device of claim 1, wherein the housing accommodates various sized strainers, wherein the strainer is sized according to a size of the electrical power cord.

5. The electrical plug repair device of claim 1, wherein the electrical power cord comprises a second electrical plug on a distal end.

6. The electrical plug repair device of claim 1, wherein the housing comprises compression ribs to receive and support the strain relief of the strainer.

7. The electrical plug repair device of claim 1, wherein the electrical plug is compliant with NEMA 5-15.

8. The electrical plug repair device of claim 1, wherein the male electrical prongs comprise a common tab, a hot tab, and a ground tab.

9. The electrical plug repair device of claim 1, wherein the electrical plug repair device comparably substitutes an original plug device that has been severed from the electrical cord.

10. The electrical plug repair device of claim 1, wherein a second end of the electrical power cord is coupled to the appliance to deliver electrical power from the electrical plug.

11. A method for repairing an electrical plug powering an electrical device through an electrical cord, comprising:

securing an electrical power cord to a housing, comprising a base enclosure and a top enclosure that snap together;

providing support for conduction wires with a strainer to encapsulate a first end of the electrical power cord and comprising a strain relief coupled to the housing, wherein the strain relief provides support for conduction wires exposed from a skin of the first end of the electrical power cord by decoupling external force on the electrical power cord from the conduction wires, wherein the housing includes individual channels for each of the exposed conduction wires, each individual channel insulated from each other and including a plurality of teeth to bite the exposed conduction wires; and inserting male electrical prongs, configured for insertion to the electrical plug to draw electrical power for the electrical device, for coupling to the housing, wherein each of the individual channels supports one of the electrical prongs for electrical connection to an exposed wire.

12. The method of claim 11, when the housing is closed with the top enclosure snapped to the base enclosure, the plurality of teeth bite the exposed conduction wires.

13. The method of claim 11, wherein the housing is configured to have the male electrical prongs removed for replacement with a female plug.

14. The method of claim 11, wherein the housing accommodates various sized strainers, wherein the strainer is sized according to a size of the electrical power cord.

15. The method of claim 11, wherein the electrical power cord comprises a second electrical plug on a distal end.

16. The method of claim 11, wherein the housing comprises compression ribs to receive and support the strain relief of the strainer.

17. The method of claim 11, wherein the electrical plug is compliant with NEMA 5-15.

18. The method of claim 11, wherein the male electrical prongs comprise a common tab, a hot tab, and a ground tab.

19. The method of claim 11, wherein the electrical plug repair device comparably substitutes an original plug device that has been severed from the electrical cord.

20. The method of claim 11, wherein a second end of the electrical power cord is coupled to the appliance to deliver electrical power from the electrical plug.

* * * * *